US011527847B2

(12) United States Patent
Oosaka et al.

(10) Patent No.: US 11,527,847 B2
(45) Date of Patent: Dec. 13, 2022

(54) ELECTRICAL CONNECTOR WITH SHIELDING FEATURES INTEGRAL WITH A LATERAL WALL OF A FRAME

(71) Applicant: Japan Aviation Electronics Industry, Limited, Tokyo (JP)

(72) Inventors: Junji Oosaka, Tokyo (JP); Yohei Yokoyama, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 17/212,328

(22) Filed: Mar. 25, 2021

(65) Prior Publication Data

US 2021/0359459 A1 Nov. 18, 2021

(30) Foreign Application Priority Data

May 13, 2020 (JP) ..... JP2020-084468
May 26, 2020 (JP) ..... JP2020-091146
(Continued)

(51) Int. Cl.
*H01R 13/518* (2006.01)
*H01R 13/629* (2006.01)
(Continued)

(52) U.S. Cl.
CPC ..... *H01R 13/518* (2013.01); *H01R 12/712* (2013.01); *H01R 12/716* (2013.01);
(Continued)

(58) Field of Classification Search
CPC .. H01R 13/518; H01R 12/712; H01R 12/716; H01R 13/502; H01R 13/629;
(Continued)

(56) References Cited

U.S. PATENT DOCUMENTS

2021/0175649 A1* 6/2021 Amemori ..... H01R 12/712

FOREIGN PATENT DOCUMENTS

CN 209709222 U 11/2019
CN 211126218 U 7/2020
(Continued)

OTHER PUBLICATIONS

Office Action dated Jan. 10, 2022 in TW Application No. 110110764, 9 pages.

*Primary Examiner* — Abdullah A Riyami
*Assistant Examiner* — Justin M Kratt
(74) *Attorney, Agent, or Firm* — Muncy, Geissler, Olds & Lowe, P.C.

(57) ABSTRACT

Provided is a connector having the smaller number of constituting components while ensuring strength and blocking property of a frame. The connector of the invention includes a frame and is capable of allowing a counter connector to be fitted in an inside of the frame, and the connector includes a lateral wall provided to the frame and surrounding the counter connector which is in a state of being fitted with the connector, a first terminal and a second terminal separately disposed at different positions in the inside of the frame, and a blocking portion disposed between the first terminal and the second terminal in the inside of the frame. The lateral wall is seamlessly continuous over an entire circumference of the frame, and the lateral wall and the blocking portion are formed of a single member and are integrated.

12 Claims, 9 Drawing Sheets

(30) Foreign Application Priority Data

| | | |
|---|---|---|
| Jun. 12, 2020 | (JP) | JP2020-102280 |
| Jun. 18, 2020 | (JP) | JP2020-105098 |
| Jul. 14, 2020 | (JP) | JP2020-120397 |
| Jul. 16, 2020 | (JP) | JP2020-121984 |
| Aug. 5, 2020 | (JP) | JP2020-132981 |
| Aug. 25, 2020 | (JP) | JP2020-141324 |
| Sep. 16, 2020 | (JP) | JP2020-155230 |
| Sep. 28, 2020 | (JP) | JP2020-161721 |
| Nov. 4, 2020 | (JP) | JP2020-184224 |

(51) Int. Cl.

| | |
|---|---|
| ***H01R 13/502*** | (2006.01) |
| ***H01R 13/6581*** | (2011.01) |
| ***H01R 12/71*** | (2011.01) |
| ***H01R 13/6585*** | (2011.01) |
| *H01R 12/73* | (2011.01) |
| *H01R 13/658* | (2011.01) |
| *H01R 13/648* | (2006.01) |
| *H01R 13/20* | (2006.01) |
| *H01R 13/6471* | (2011.01) |
| *H01R 13/6594* | (2011.01) |

(52) U.S. Cl.

CPC ..... *H01R 13/502* (2013.01); *H01R 13/629* (2013.01); *H01R 13/6581* (2013.01); *H01R 13/6585* (2013.01); *H01R 12/71* (2013.01); *H01R 12/73* (2013.01); *H01R 13/20* (2013.01); *H01R 13/648* (2013.01); *H01R 13/6471* (2013.01); *H01R 13/658* (2013.01); *H01R 13/6594* (2013.01)

(58) Field of Classification Search

CPC ..... H01R 13/6581; H01R 13/6585; H01R 12/71; H01R 12/73; H01R 13/648; H01R 13/658; H01R 13/20; H01R 13/6471; H01R 13/6594

See application file for complete search history.

(56) References Cited

FOREIGN PATENT DOCUMENTS

| | | | | | |
|---|---|---|---|---|---|
| KR | 2020008840 | A | * | 1/2020 | ..... H01R 13/629 |
| KR | 20200008840 | A | | 1/2020 | |
| TW | 202010200 | A | | 3/2020 | |

* cited by examiner

ELECTRICAL CONNECTOR WITH SHIELDING FEATURES INTEGRAL WITH A LATERAL WALL OF A FRAME

BACKGROUND OF THE INVENTION

The present invention relates to a connector, in particular, to a connector including a frame and being capable of allowing a counter connector to be fitted in an inside of the frame.

A conventional connector including a frame is exemplified by the connector described in the specification of CN Utility Model No. 211126218 (hereinafter, referred to as "connector 1"). The connector 1 is a receptacle connector shown in FIG. 17 and is capable of allowing a counter connector that is a plug connector (not shown) to be fitted in an inside of a frame 3 having an opening 2. The frame 3 takes on a square tubular shape and surrounds the counter connector which is in a state of being fitted with the connector 1.

In the inside of the frame 3, a signal transmitting terminal 4 shown in FIG. 17 is disposed, and electromagnetic interference to the terminal 4 from an outside is blocked by the frame 3. The frame 3 is formed by machining a metal sheet, for example. In this case, by having the metal sheet subjected to deep drawing process, for example, the frame 3 which is seamlessly continuous in a circumferential direction as shown in FIG. 18 can be obtained. This type of seamless frame 3 is excellent in strength and blocking property.

In a case where a plurality of terminals 4 are disposed in the inside of the frame 3, a blocking portion 5 is disposed between the terminals 4 as shown in FIG. 18. The blocking portion 5 is an electromagnetic shield and suppresses interference, more specifically, crosstalk between the terminals 4.

SUMMARY OF THE INVENTION

A connector that can be more easily assembled is desirable, and a connector having the smaller number of constituting components can be assembled in an easier and less expensive manner. Therefore, it is desired to develop a connector having the smaller number of constituting components while including the seamless frame 3 like the connector 1 shown in FIGS. 17 and 18.

The present invention has been made in view of the above circumstances and is aimed at attaining an object described below. The present invention is to solve the conventional problem above and to provide a connector having the smaller number of constituting components while ensuring strength and blocking property of the frame.

In order to attain the above-described object, the connector according to the present invention is a connector including a frame and being capable of allowing a counter connector to be fitted in an inside of the frame, the connector comprising: a lateral wall provided in the frame and surrounding the counter connector which is in a state of being fitted with the connector; a first terminal and a second terminal separately disposed at different positions in the inside of the frame; and a blocking portion disposed between the first terminal and the second terminal in the inside of the frame, wherein the lateral wall is seamlessly continuous over an entire circumference of the frame, and wherein the lateral wall and the blocking portion are formed of a single member and are integrated.

According to the invention, since the lateral wall of the frame is seamlessly continuous over an entire circumference of the frame, strength and blocking property (shielding property) of the frame are ensured. In addition, since the lateral wall of the frame and the blocking portion are formed of a single member and are integrated, the number of constituting components decreases. Accordingly, the assembling of the connector is facilitated, and the production cost of the connector can be reduced.

DETAILED DESCRIPTION OF THE INVENTION

Hereinafter, a connector according to the invention will be described with reference to a specific example shown in the appended drawings. An embodiment described below is only an example presented for easy understanding of the invention, and the invention is by no means limited thereto. In other words, the invention may be modified or improved from the embodiment described below without departing from the scope and spirit of the invention. The materials, shapes, design dimensions and other factors of the respective portions of the connector according to the invention can be determined depending on the application of the invention, the state of the art at the time when the invention is carried out, and other conditions. Needless to say, the invention includes its equivalents.

In addition, in the following description, three directions intersecting orthogonally to one another are defined as an X direction, a Y direction and a Z direction, and a direction in which the connector is fitted with a counter connector coincides with the Z direction. Here, it is assumed that the Z direction is equal to a vertical direction of the connector, the X direction to a lateral width direction of the connector, and the Y direction to a front-back direction of the connector.

It is also assumed that the shapes, positions and the like of the respective portions of the connector to be described below are those when viewed with the +Z side being the upper side of the connector and the −Z side being the lower side of the connector. The +Z side (upper side) is a side on which the counter connector is situated with respect to the connector in the Z direction, and the −Z side (lower side) is a side on which the connector is situated with respect to the counter connector in the Z direction.

In this description, meaning of the terms "orthogonal" or "parallel" encompasses an error range generally allowed in the technical field of the connector and includes the cases where a shift within a range of less than a few degrees (e.g., 2 to 3 degrees) with respect to an exact orthogonality or parallel is present.

In addition, for convenience of the description, hereinafter, the fitting of the connector with the counter connector is called "connector fitting," and a state in which the connector is fitted with the counter connector "connector fitting state."

<<Configuration Example of Connector>>

Figure 16:
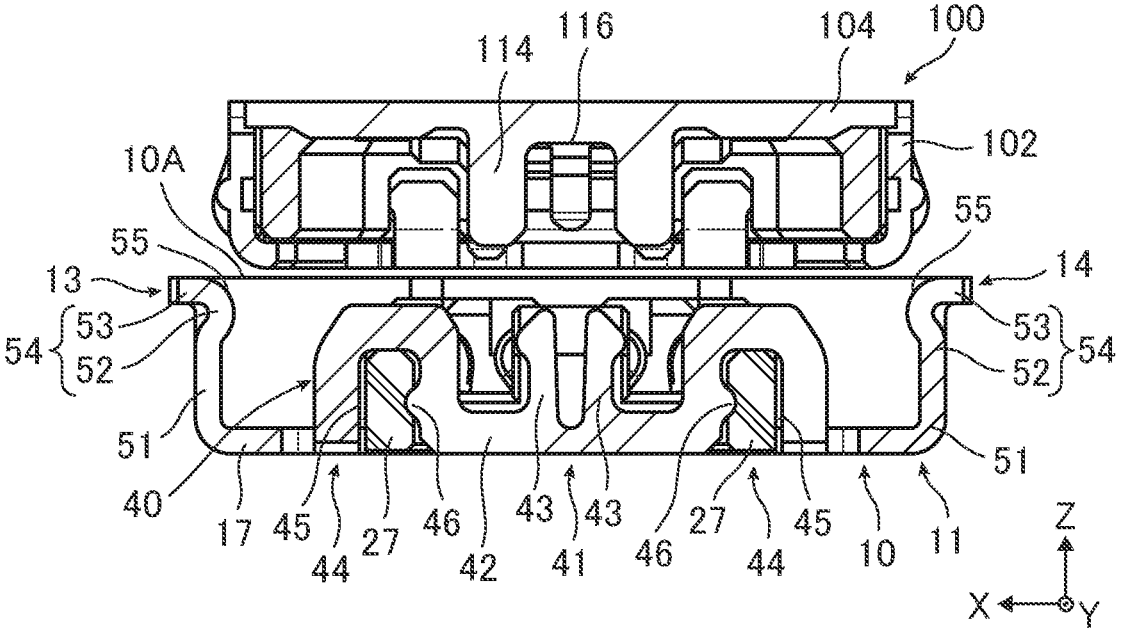
FIG. 16 is a view showing the connector and the counter connector in the process of fitting and is a view showing a cross-section corresponding to the cross-section taken along J-J in FIG. 9.
Figure 17:
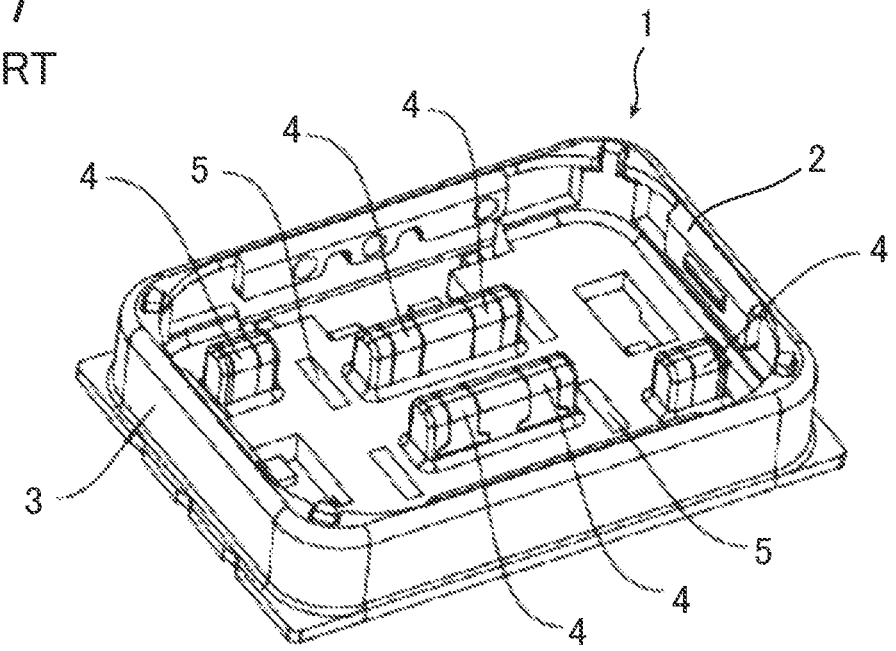
FIG. 17 PRIOR ART
FIG. 17 is a perspective view of a connector according to a conventional example.
Figure 18:
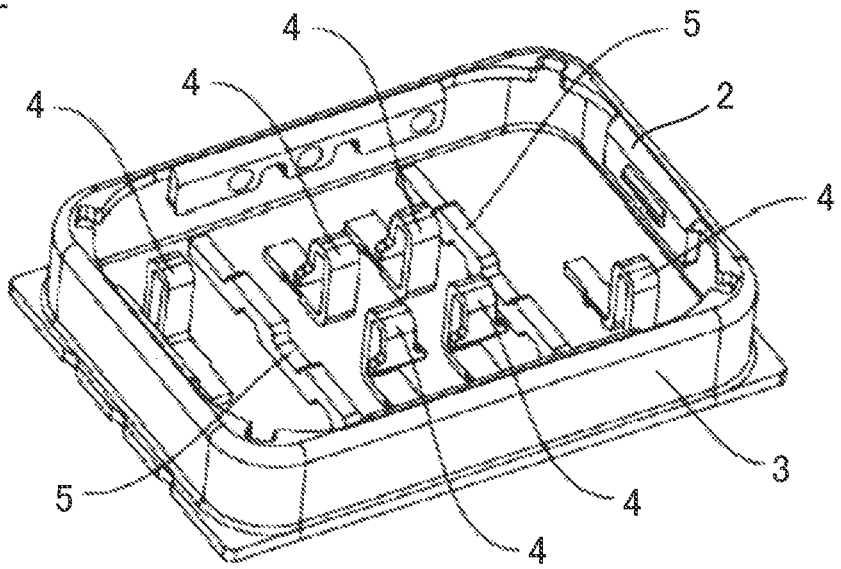
FIG. 18 PRIOR ART
FIG. 18 is a perspective view showing a frame and a blocking portion provided to the connector according to the conventional example.

The configuration of the connector according to the embodiment of the invention (hereinafter, referred to as "connector 10") will be described with reference to FIGS. 1 to 16. FIGS. 12, 13 and 16 show cross-sections (XZ plane) passing a blocking portion 40 described later.

The connector 10 is a receptacle connector shown in FIGS. 1 to 5 and is mounted on a board (not shown) with the lower end of the connector 10 being fixed to the board. The connector 10 can be fitted in the vertical direction (Z direction) with a counter connector 100 that is a plug connector shown in FIG. 6.

Figure 1:
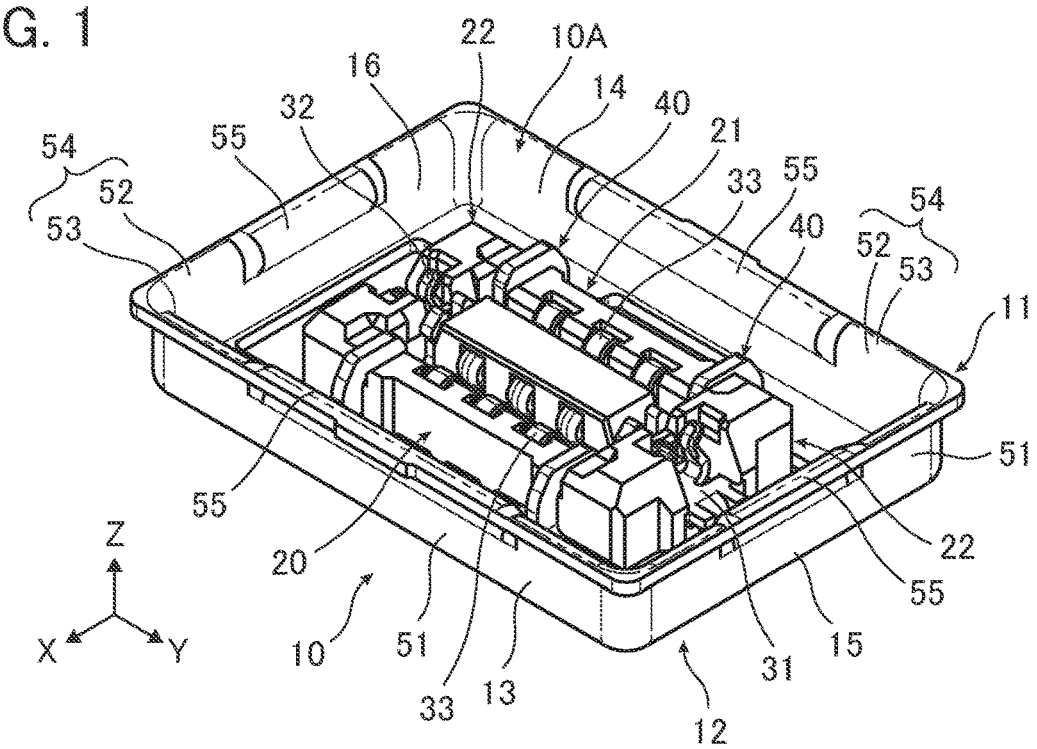
FIG. 1 is a perspective view of a connector according to an embodiment of the present invention.
Figure 2:
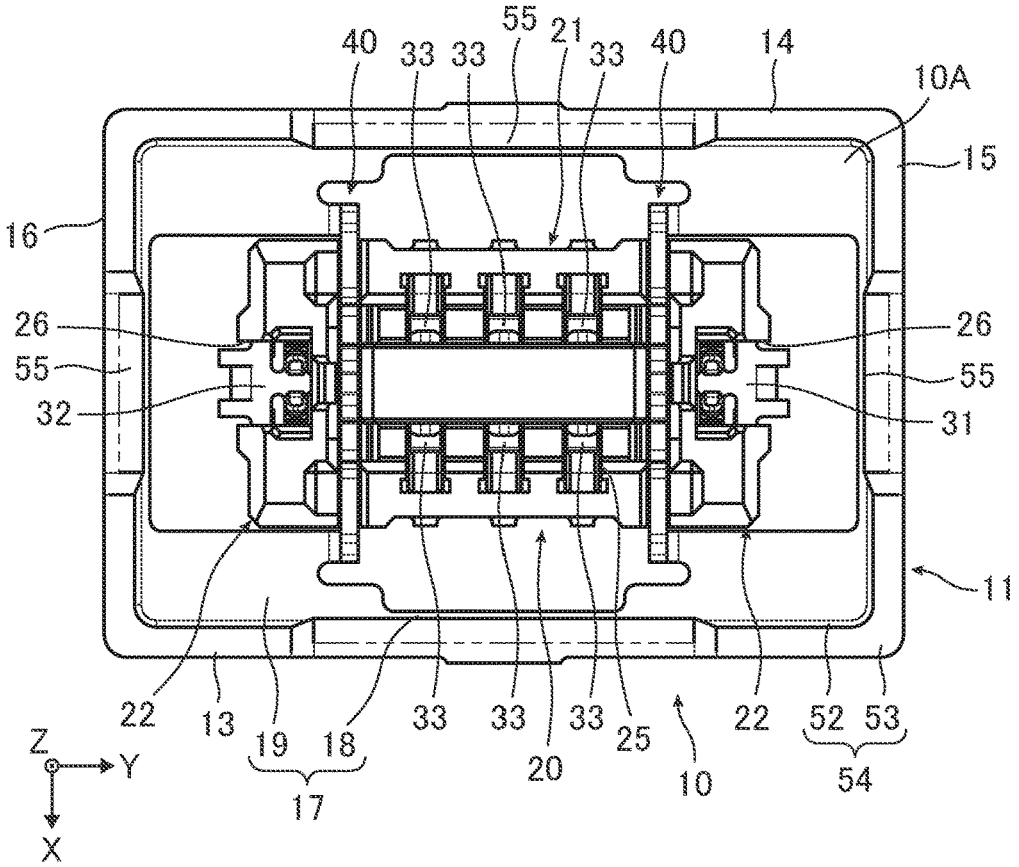
FIG. 2 is a plan view of the connector according to the embodiment of the present invention.
Figure 3:
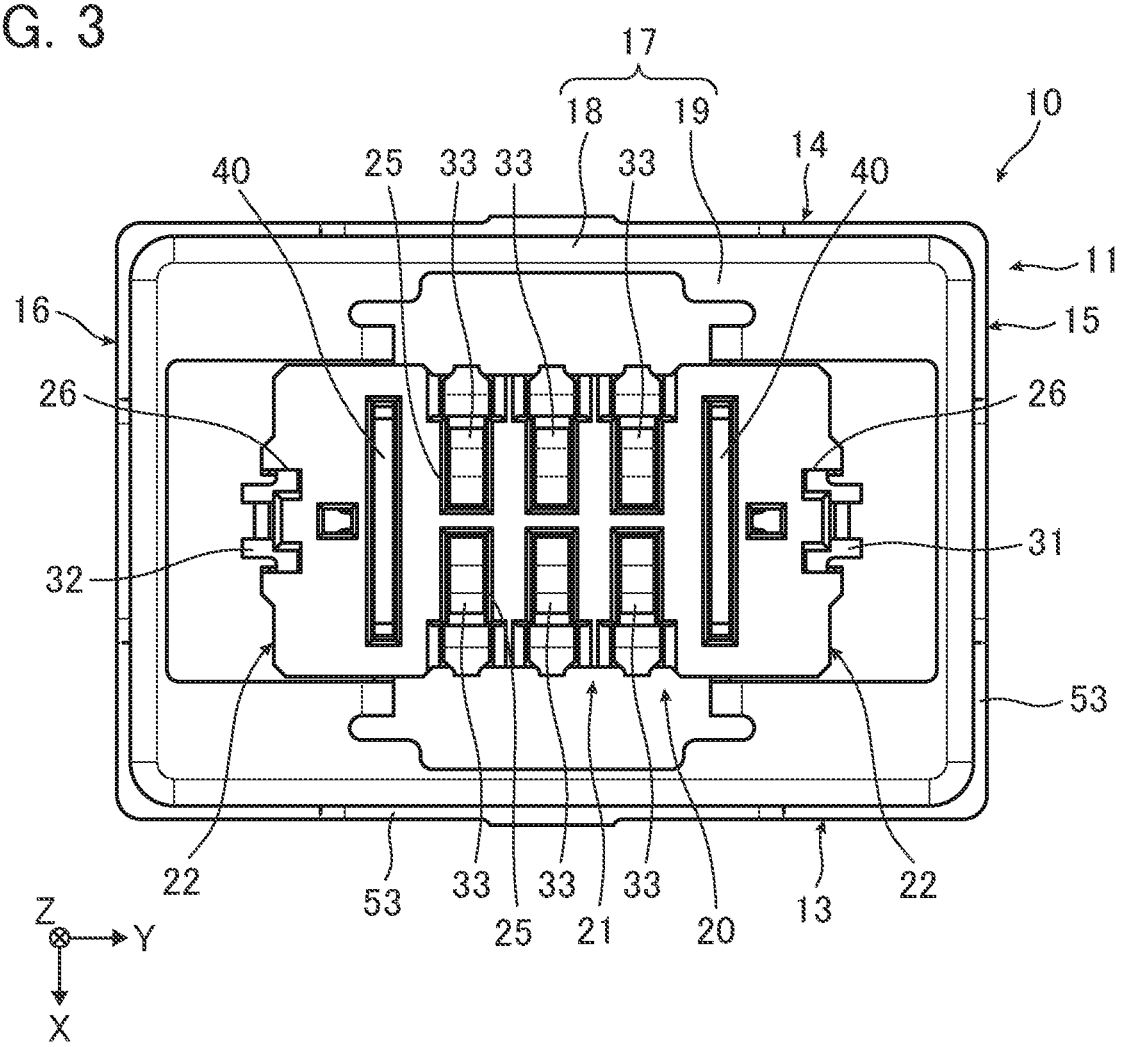
FIG. 3 is a bottom view of the connector according to the embodiment of the present invention.
Figure 4:
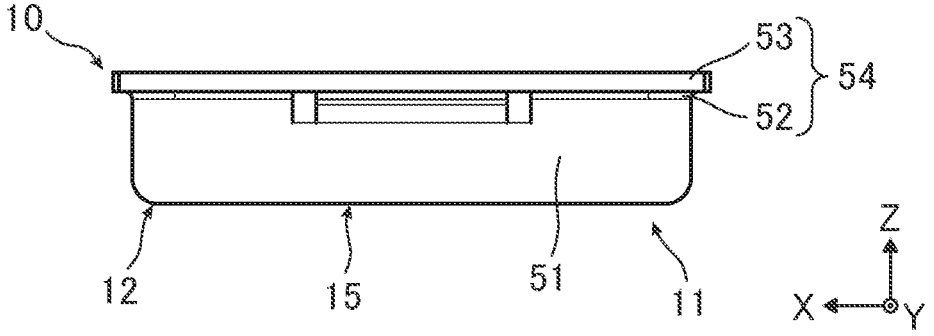
FIG. 4 is a front view of the connector according to the embodiment of the present invention.
Figure 5:
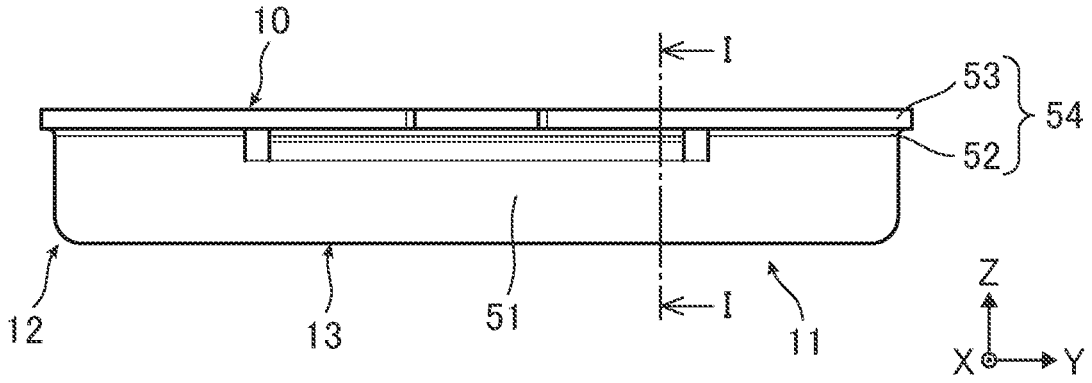
FIG. 5 is a side view of the connector according to the embodiment of the present invention.
Figure 6:
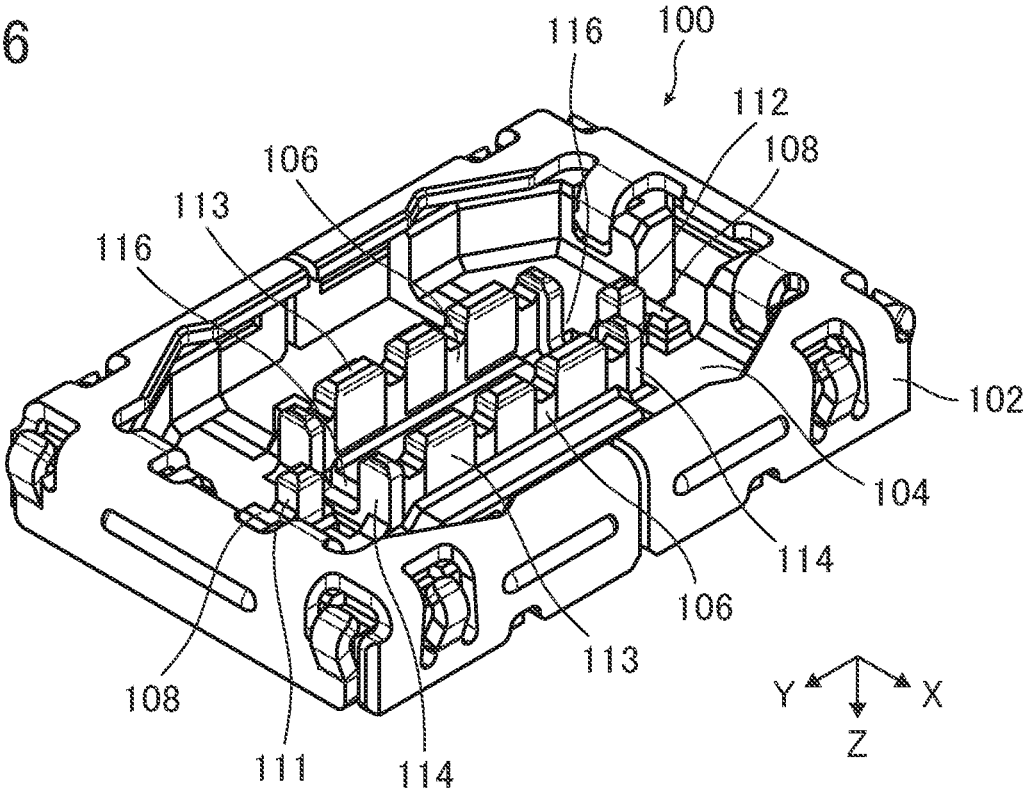
FIG. 6 is a perspective view of a counter connector.
Figure 7:
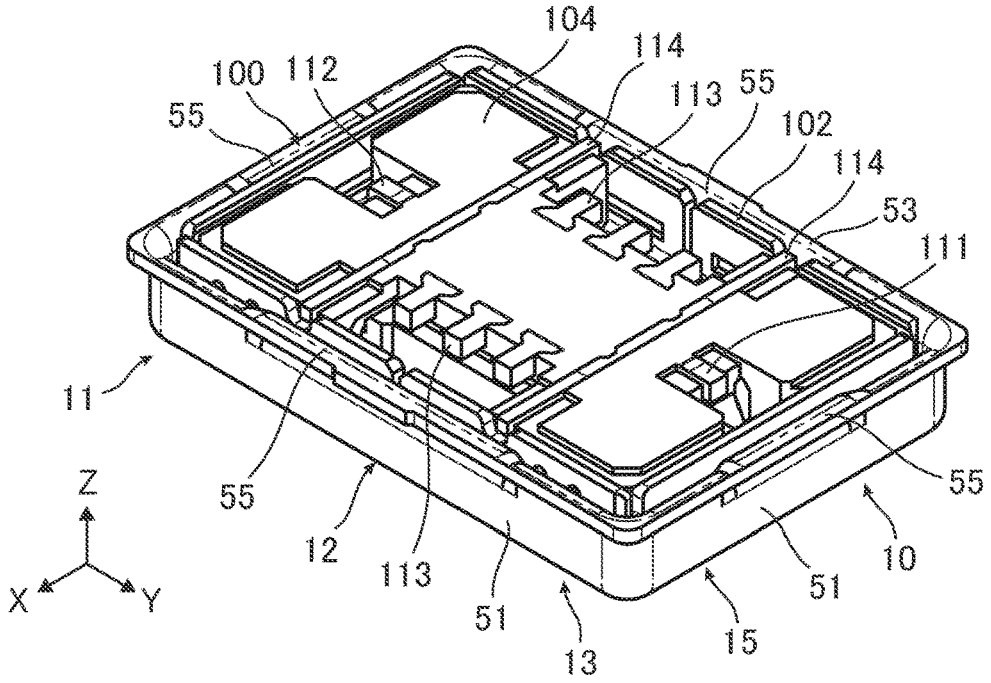
FIG. 7 is a perspective view of the connector fitted with the counter connector.

As shown in FIGS. 1 to 3, the connector 10 includes a frame 11, a housing 20, and a plurality of contacts 31, 32 and 33. As shown in FIGS. 6 and 7, the counter connector 100 includes a counter frame 102, a bottom wall 104, contact holding portions 106 and 108, and counter contacts 111, 112 and 113.

The frame 11 constitutes an outer peripheral wall of the connector 10, while the counter frame 102 constitutes an outer peripheral wall of the counter connector 100. The frame 11 and the counter frame 102 are each a hollow frame having a substantially rectangular shape in a plan view and made of a conductive material such as a metal sheet. As shown in FIGS. 1 and 2, the frame 11 surrounds a recess space that is formed thereinside. An opening 10A is provided at an upper end (an end in the Z direction) of the frame 11.

At the time of connector fitting, as shown in FIGS. 7 and 16, the counter connector 100 is fitted in the recess space formed in an inside of the frame 11 through the opening 10A. In the connector fitting state, the frame 11 surrounds the counter connector 100 over an entire circumference of the counter connector 100, and an inner peripheral surface of the frame 11 is in contact with an outer peripheral surface of the counter frame 102.

In the connector 10, as shown in FIGS. 1 and 2, the housing 20 and the contacts 31, 32 and 33 are disposed in the inside of the frame 11. In the counter connector 100, on the other hand, as shown in FIG. 6, the counter contacts 111, 112 and 113 are disposed at positions respectively corresponding to the contacts 31, 32 and 33 in an inside of the counter frame 102. The counter contacts 111, 112 and 113 are held by the protrusion-shaped contact holding portions 106 and 108 protruding from the bottom wall 104.

The contacts 31, 32 and 33 are signal transmitting or power-feeding terminals and are disposed in the inside of the frame 11 as shown in FIGS. 1 and 2. Two contacts 31 and 32 of these contacts are each a high-frequency signal transmitting terminal, that is, a radio frequency (RF) terminal. For instance, a frequency band of 6 GHz or higher corresponds to the high frequency, and examples thereof include a frequency band used in the 5th generation (5G) technology.

The contacts 31 and 32 form a pair and are separately disposed on different positions from each other, more specifically, disposed at symmetrical positions with respect to the center of the connector 10 in the Y direction. The contact 31 disposed on the +Y side corresponds to a first terminal, while the contact 32 disposed on the −Y side to a second terminal. In the X direction, the pair of the contacts 31 and 32 may be disposed at positions coinciding each other or at different positions from each other.

As shown in FIGS. 1 and 2, a plurality (six in the embodiment of the drawings) of the contacts 33 are disposed in the inside of the frame 11. The plurality of the contacts 33 at least include a low-frequency signal transmitting terminal and may further include a power-feeding terminal. The contacts 33 each correspond to a third terminal and are disposed between the contact 31 that is the first terminal and the contact 32 that is the second terminal in the Y direction. The contacts 33 may be disposed regularly in the X direction and the Y direction, e.g., symmetrically with respect to the center of the connector 10, or may be disposed in a random manner.

In the connector fitting state, the contacts 31, 32 and 33 are in contact with and electrically connected to the corresponding counter contacts 111, 112 and 113. The contact 31 corresponds to the counter contact 111, while the contact 32 corresponds to the counter contact 112. For instance, the contacts 31, 32 and 33 each have an arch-shaped portion opening to the +Z side, while the counter contacts 111, 112 and 113 are each formed in a bar shape. Each of the counter contacts is inserted to an inside of the arch-shaped portion of the corresponding contact, whereby they come into contact with and are electrically connected to each other.

The housing 20 is an insulating component for holding the contacts 31, 32 and 33 and is disposed in the inside of the frame 11, i.e., the recess space. As shown in FIGS. 1 and 2, the housing 20 has a substantially rectangular shape in a plan view and is divided into multiple portions.

More specifically, the housing 20 includes a portion constituting the Y directional center portion of the housing 20 (hereinafter, housing center portion 21) and portions constituting the opposite end portions in the Y direction of the housing 20 (hereinafter, housing end portions 22). As shown in FIGS. 1 and 2, the housing center portion 21 includes a protrusion portion situated at the center portion in the X direction (hereinafter, center protrusion portion 23) and protrusion portions situated on opposite sides of the center protrusion portion 23 in the X direction (side protrusion portions 24). The center protrusion portion 23 and the two side protrusion portions 24 extend in the Y direction, and a recess-shaped fitting groove 25 is formed between the center protrusion portion 23 and each of the side protrusion portions 24. The contact 33 is fitted into each of the fitting grooves 25 (see FIG. 10).

The housing end portion 22 on the +Y side and the housing end portion 22 on the −Y side are configured to be symmetrical to each other with respect to the center of the connector 10 in the Y direction. As shown in FIG. 1, each housing end portion 22 forms a protrusion portion extending in the X direction. The housing end portion 22 is provided at an outer end portion thereof in the Y direction with a recess portion formed to be dented to an inner side in the Y direction (hereinafter, fitting recess portion 26) as shown in FIG. 2. The contact 31 and the contact 32 are pressed to the inner side in the Y direction to be fitted into the fitting recess portion 26 provided to the housing end portion 22 on the +Y side and the fitting recess portion 26 provided to the housing end portion 22 on the −Y side, respectively.

The housing center portion 21 and each of the housing end portions 22 are joined to and integrated with each other through an inserted portion 27 described later in detail that is disposed between the housing center portion 21 and the housing end portion 22 (see FIG. 10). The housing 20 is, for example, a resin molded component, and the housing 20 including the housing center portion 21 and the housing end portions 22 joined to one another is formed in a single resin molding process.

Figure 10:
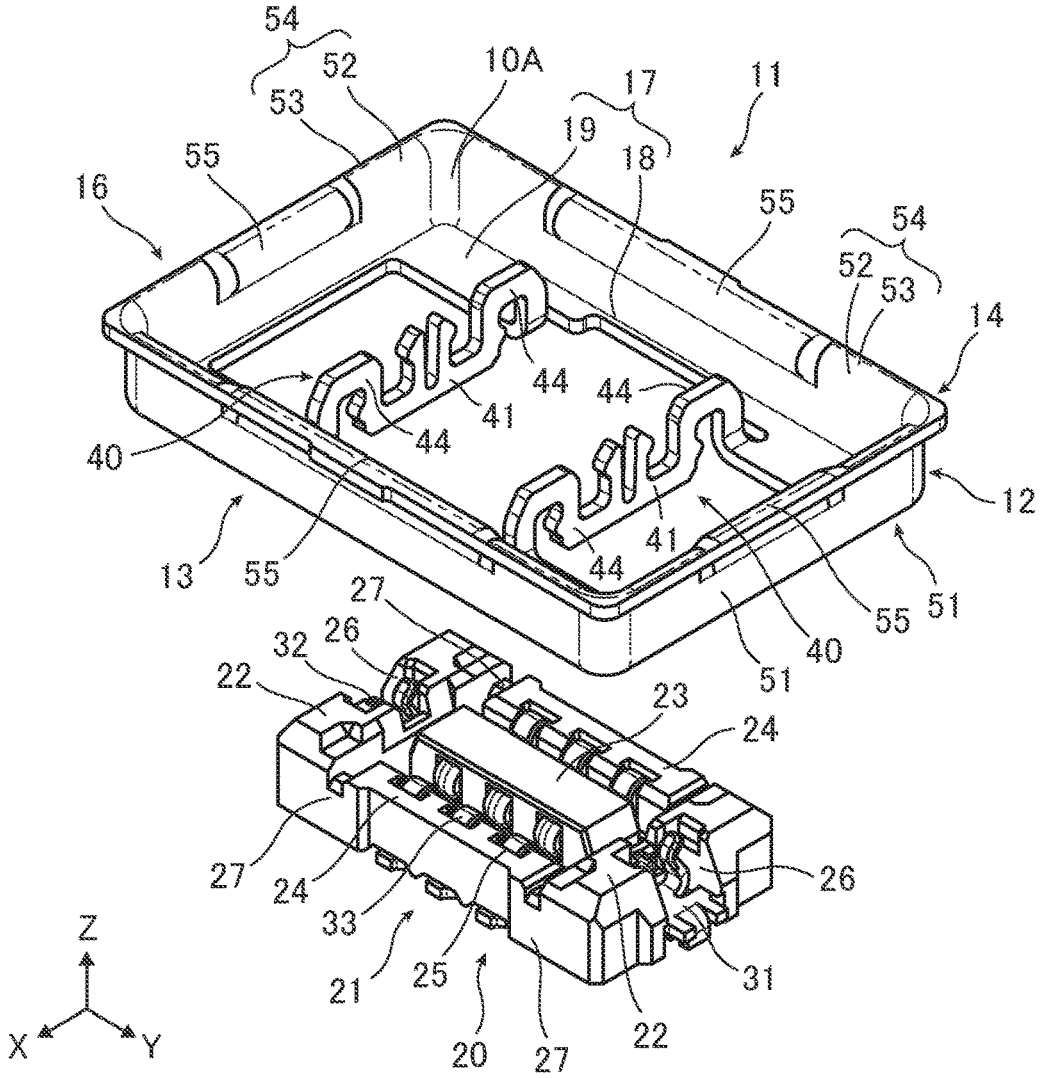
FIG. 10 is an exploded view of the connector according to the embodiment of the present invention.

In addition, as shown in FIGS. 1, 2 and 10, the connector 10 is provided with the blocking portion 40 in the inside of the frame 11. The blocking portion 40 is disposed between the pair of contacts 31 and 32 in the Y direction (i.e., intersecting direction intersecting the Z direction) as shown in FIG. 2.

More specifically, the blocking portion 40 is disposed each between the contact 31 on the +Y side and the plurality of contacts 33 and between the contact 32 on the −Y side and the plurality of contacts 33 in the Y direction. In other words, in the case shown in FIG. 1 and other drawings, two blocking portions 40 are disposed between the pair of contacts 31 and 32 in the inside of the frame. Meanwhile, the number of the blocking portions 40 is not particularly limited, as long as at least one blocking portion 40 is disposed between the pair of contacts 31 and 32.

The blocking portion 40 is connected to a ground potential. In particular, a grounding conductive pattern (not shown) is formed on the board on which the connector 10 is mounted, and the blocking portion 40 is disposed such that the lower end of the blocking portion 40 is in contact with the grounding conductive pattern. In the connector fitting state, as shown in FIG. 13, the blocking portion 40 is fitted with a counter blocking portion 114 included in the counter connector 100 to form an electromagnetic shield. The electromagnetic shield suppresses crosstalk of signals (specifically, high-frequency signals) between the pair of contacts 31 and 32.

Next, the configuration of the frame 11 will be described in detail. The frame 11 is conductive, and in the inside of the frame 11, the contacts 31, 32 and 33 are disposed. In other words, the contacts 31, 32 and 33 are surrounded by the conductive frame 11. In addition, the frame 11 is in contact with the grounding conductive pattern (not shown) of the board, on which the connector 10 is mounted, and is connected to the ground potential. With this configuration, the frame 11 exhibits shielding property and blocks an influence (electromagnetic interference) from an outside to the contacts 31, 32 and 33.

Figure 11:
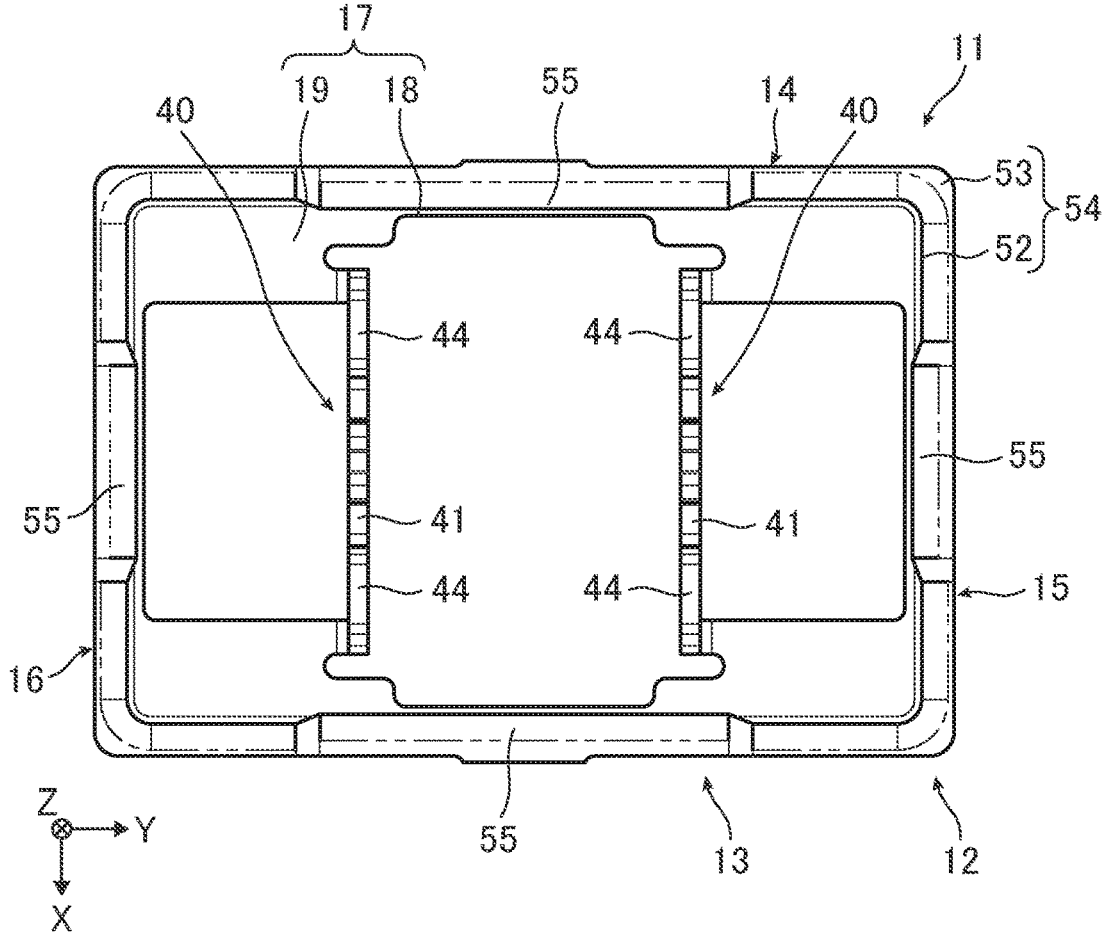
FIG. 11 is a plan view of a frame and a blocking portion.
Figure 12:
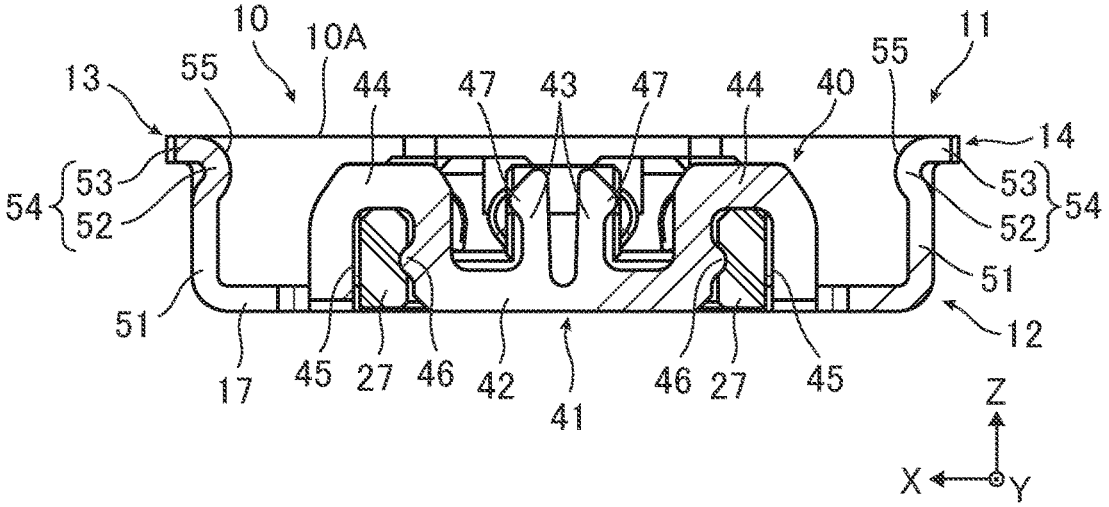
FIG. 12 is a view showing a cross-section taken along I-I in FIG. 5.
Figure 13:
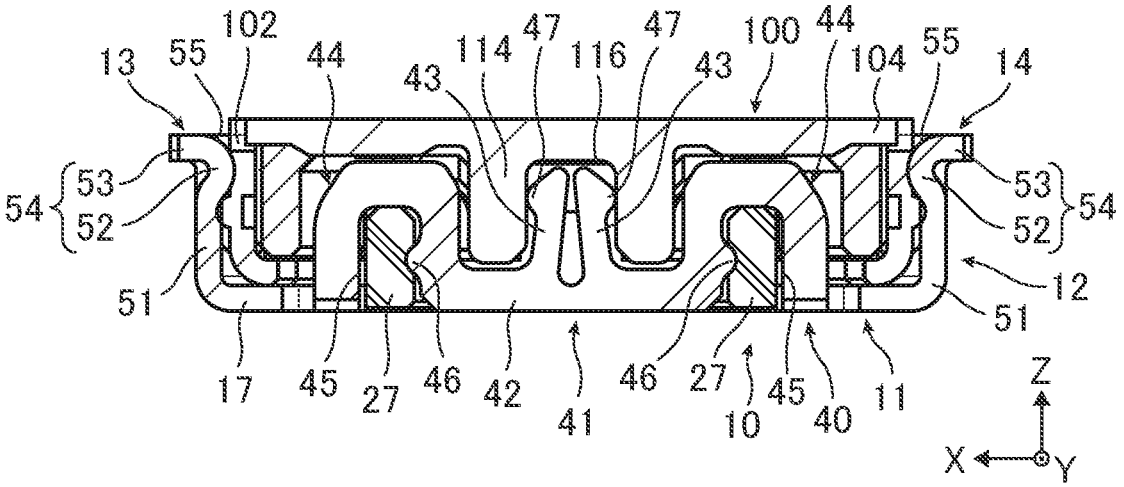
FIG. 13 is a view showing a cross-section taken along J-J in FIG. 9.

As shown in FIGS. 10 to 12, the frame 11 includes a lateral wall 12 and a bottom wall 17. As shown in FIG. 11, the lateral wall 12 has a rectangular shape in a plan view and surrounds an outer lateral surface of the housing 20. In the connector fitting state, an inner peripheral surface of the lateral wall 12 is in contact with an outer peripheral surface of the counter connector 100 (in particular, an outer peripheral surface of the counter connector frame 102).

As shown in FIGS. 10 and 11, the lateral wall 12 includes a pair of long side portions 13 and 14 and a pair of short side portions 15 and 16. The pair of long side portions 13 and 14 are disposed to be aligned in parallel to each other at an interval in the X direction and extend long in the Y direction. The pair of short side portions 15 and 16 each extend in the X direction and interconnect end portions in the longitudinal direction of the long side portions 13 and 14. The short side portions 15 and 16 have a shorter length than that of the long side portions 13 and 14.

The respective portions of the lateral wall 12 (i.e., the pair of long side portions 13 and 14 and the pair of short side portions 15 and 16) are joined to one another without seam or gap as shown in FIGS. 10 to 12. In other words, the lateral wall 12 is seamlessly continuous over an entire circumference of the frame 11. The entire circumference of the frame 11 corresponds to an entire region in the circumferential direction of the frame 11, while the circumferential direction of the frame 11 corresponds to a direction in which the frame 11 surrounds the recess space, that is, a direction along an outer edge of the recess space.

The pair of long side portions 13 and 14 and the pair of short side portions 15 and 16 are each provided with a rising portion 51 rising from the bottom wall 17 and extending to the +Z side as shown in FIG. 12. In addition, as shown in FIGS. 10 and 12, the pair of long side portions 13 and 14 and the pair of short side portions 15 and 16 are each provided with, at their top end portions (i.e., end portions on the side on which the opening 10A is situated in the Z direction), a bending portion 52 and a flange portion 53.

The bending portion 52 is continuous with the rising portion 51 and is a portion bending toward an outside of the frame 11. The flange portion 53 is continuous with the bending portion 52 and is a jaw-like portion extending from the bending portion 52 toward the outside of the frame 11.

The bending portion 52 and the flange portion 53 are provided in the frame 11 so as to surround the opening 10A and form a guide portion 54. The guide portion 54 is provided at an end portion on the opening 10A side in the Z direction (i.e., top end portion) of the lateral wall 12 and is to guide the counter connector 100 to the inside of the frame 11 through the opening 10A. Since the guide portion 54 is provided, the counter connector 100 can be properly guided to the inside of the frame 11 such that the counter connector 100 is accurately positioned in the inside of the frame 11 at the time of connector fitting.

In addition, as shown in FIGS. 10 and 11, the guide portion 54 is provided at the top end portion of the lateral wall 12 (end portion on the opening 10A side) over the entire circumference of the frame 11. With this configuration, the counter connector 100 can be smoothly guided to the inside of the frame 11 at the time of connector fitting. More specifically, for example, with a configuration in which the guide portion 54 is discontinued in the circumferential direction of the frame 11, the counter connector 100 may be caught at a site where the guide portion 54 is discontinued. On the other hand, the guide portion 54 is provided over the entire circumference of the frame 11 so that the above-described inconvenience can be prevented at the time of connector fitting.

The frame 11 is in contact with the outer peripheral surface of the counter connector 100 in the connector fitting state, and this state can be suitably maintained. More specifically, the Y directional center portions of the respective long side portions 13 and 14 and the X directional center portions of the respective short side portions 15 and 16 are each provided with a protrusion portion 55 as shown in FIG.

11. The protrusion portion 55 is a portion protruding farther to the inside of the frame 11 as compared with other portions (other portions than the protrusion portion 55) in the lateral wall 12 as shown in FIG. 12. The protrusion portion 55 is provided at the top end portion of the lateral wall 12 in the Z direction, more specifically, in the vicinity of the boundary between the rising portion 51 and the bending portion 52.

Figure 8:
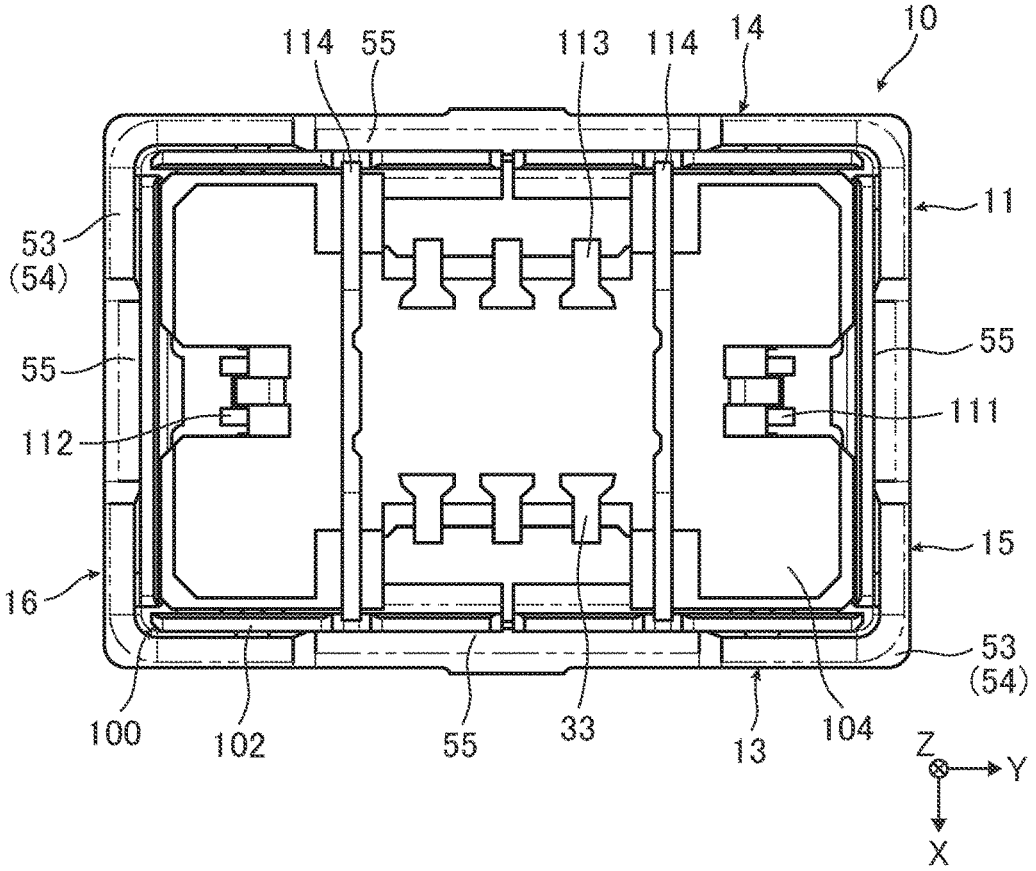
FIG. 8 is a plan view of the connector fitted with the counter connector.
Figure 9:
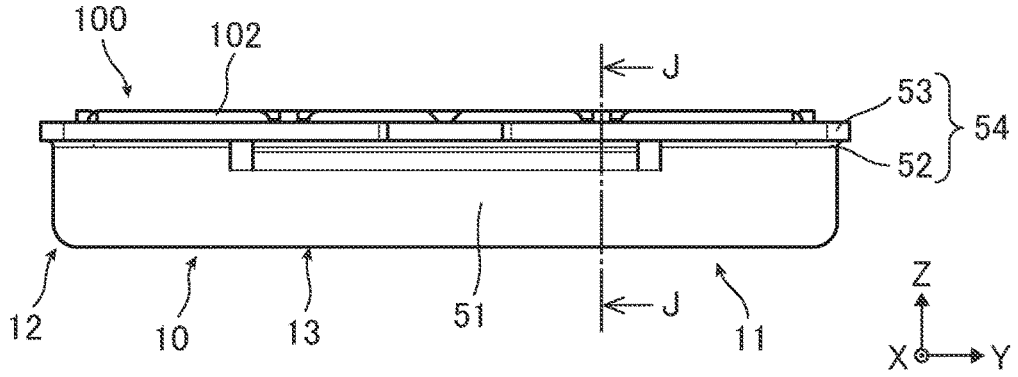
FIG. 9 is a side view of the connector fitted with the counter connector.

In the connector fitting state, as shown in FIG. 8, in the inner peripheral surface of the lateral wall 12, a region provided with the protrusion portion 55 is in contact with the outer peripheral surface of the counter connector 100, more precisely, the outer peripheral surface of the counter frame 102. Since the protrusion portion 55 is provided to the lateral wall 12 in this manner, the lateral wall 12 can easily come into contact with the counter connector 100, and as a result, the connector fitting state can be stabilized and suitably maintained.

For instance, the protrusion portion 55 is formed by pressing, of a member constituting the lateral wall 12 (specifically, a metal sheet M described later), a portion in which the protrusion portion 55 is to be formed toward the inside of the frame 11 to be bent into an arch shape as shown in FIG. 12. The protrusion portions 55 provided to the long side portions 13 and 14 may have a length of one third or more, preferably a length of a half or more of the length of the long side portions 13 and 14 in the Y direction. The protrusion portions 55 provided to the short side portions 15 and 16 may have a length of one third or more, preferably a length of a half or more of the length of the short side portions 15 and 16 in the X direction.

The bottom wall 17 of the frame 11 extends from a lower end of the lateral wall 12 (end portion on the opposite side from the opening 10A in the Z direction) toward the inside of the frame 11. The bottom wall 17 is formed of a flat plate extending along an XY plane, and a large part thereof is punched out as shown in FIGS. 10 and 11. The bottom wall 17 includes an edge portion 18 having a narrow width and provided so as to edge an outer rim of the recess space in the inside of the frame 11, and a corner portion 19 formed in a substantially rectangular piece shape that is present at each of the four corners of the recess space.

As shown in FIG. 11, the blocking portion 40 is disposed between two corner portions 19 adjacent to each other in the X direction. Two pairs of the two adjacent corner portions 19 are separately provided at positions apart from each other in the Y direction, and the blocking portion 40 is disposed each between two adjacent corner portions 19 on the +Y side and between two adjacent corner portions 19 on the −Y side.

Each blocking portion 40 is continuous with part of the bottom wall 17, in particular, two adjacent corner portions 19. As shown in FIG. 12, the blocking portion 40 protrudes to the +Z side from the bottom wall 17, i.e., an end of the frame 11 on the opposite side to the opening 10A in the Z direction. In addition, the blocking portion 40 has an axisymmetric shape with respect to the center of the frame 11 in the X direction. More specifically, as shown in FIG. 12, a fitting portion 41 is provided at the center portion of the blocking portion 40 in the X direction, and an attachment portion 44 is provided at each of the opposite end portions of the blocking portion 40.

As shown in FIG. 12, the attachment portion 44 has a reversed U-shape when viewed from the Y direction and includes an insertion recess portion 45 formed from an end on the −Z side toward the +Z side in the attachment portion 44. An inserted portion 27 being part of the housing 20 is inserted into the insertion recess portion 45 as shown in FIG. 12.

The inserted portion 27 is situated between the housing center portion 21 and each of the housing end portions 22 in the Y direction and is provided at each of two axisymmetric positions with respect to the center of the housing 20 in the X direction. Each inserted portion 27 is a columnar protrusion portion having a shorter height than those of the housing center portion 21 and the housing end portions 22 in the Z direction and having a certain width in the X direction.

The insertion recess portion 45 has a depth corresponding to the height of the inserted portion 27 and has a slightly wider width than that of the inserted portion 27. In an inside of the insertion recess portion 45, a pair of inner lateral surfaces are provided and aligned in the X direction. In addition, as shown in FIG. 12, a press-fit portion 46 protrudes from, of the pair of inner lateral surfaces, an inner lateral surface on the side closer to the Y directional center of the blocking portion 40. When the inserted portion 27 is inserted into the insertion recess portion 45, the press-fit portion 46 is press-fitted into the inserted portion 27, specifically, bites into the inserted portion 27.

As described above, the inserted portion 27 is inserted into the insertion recess portion 45 to be thereby attached to the attachment portion 44. Consequently, the housing 20 is held in the inside of the frame 11 by the frame 11 through the blocking portion 40.

As shown in FIG. 12, the fitting portion 41 is situated between two attachment portions 44 in the X direction and includes a joint portion 42 provided at an end portion on the −Z side of the blocking portion 40, and a pair of projection pieces 43 projecting to the +Z side from the X directional center portion of the joint portion 42.

The joint portion 42 linearly extends in the X direction and joins the two attachment portions 44 to each other. The pair of projection pieces 43 are disposed to be aligned in a substantially V-shape when viewed from the Y direction. Each projection piece 43 is formed of, for example, a plate spring and has elasticity, and the projection pieces 43 are elastically deformable such that a distance therebetween can be narrowed. In addition, each projection piece 43 is provided at its tip end with a contact protrusion portion 47 protruding in a mountain-like shape toward an outside in the X direction as shown in FIG. 12.

In the connector fitting state, as shown in FIG. 13, the fitting portion 41 is fitted with the counter blocking portion 114 provided to the counter connector. More specifically, an X directional center portion of the counter blocking portion 114 is provided with a recess portion (hereinafter, fitting recess portion 116) formed at a position corresponding to the fitting portion 41. The fitting recess portion 116 has a depth sufficient to accommodate tip end portions (that is, contact protrusion portions 47) of both of the pair of projection pieces 43. In addition, the fitting recess portion 116 has a width (X directional length) slightly narrower than a distance between the projection pieces 43, more precisely, between the projection pieces 43 before being elastically deformed.

At the time of connector fitting, the pair of projection pieces 43 of the fitting portion 41 enter to the deeper side in the fitting recess portion 116 while being elastically deformed to narrow the distance between the projection pieces 43 as shown in FIG. 13. Consequently, the fitting portion 41 is fitted with the fitting recess portion 116. With the fitting portion 41 reaching to the innermost part of the fitting recess portion 116, the tip ends of the pair of projection pieces 43, i.e., the contact protrusion portions 47 are in contact with an inner lateral surface of the fitting recess portion 116. Here, the inner lateral surface of the fitting recess portion 116 is preferably provided with a dent formed to conform with the curved shape of the contact protrusion portion 47 so as to fit the contact protrusion portion 47.

In the state where the fitting portion 41 is fitted with the counter blocking portion 114, i.e., in the connector fitting state, the blocking portion 40 together with the counter blocking portion 114 forms an electromagnetic shield. As described above, the electromagnetic shield suppresses crosstalk of signals between the two high-frequency signal transmitting contacts 31 and 32.

In each of the blocking portion 40 on the +Y side and the blocking portion 40 on the −Y side, the fitting portion 41 and the two attachment portions 44 are preferably disposed at the same position in the Y direction as shown in FIGS. 10 and 11. In addition, it is more preferable that the fitting portion 41 and the attachment portions 44 have a substantially uniform thickness (Y directional length). In other words, in the Y direction, an end surface of the fitting portion 41 and end surfaces of the attachment portions 44 are preferably coplanar with each other. In this case, the blocking portion 40 can be miniaturized, and an installation space of the blocking portion 40 in the frame 11 can be smaller.

In the connector 10 of the invention, in order to reduce the number of constituting components, the lateral wall 12 and the bottom wall 17 of the frame 11 and the blocking portions 40 are formed of a single member and are integrated. More specifically, the lateral wall 12 and the bottom wall 17 of the frame 11 are formed of a single member, in particular, a metal sheet M, and part of the single metal sheet M is used to form the blocking portions 40. The material of the metal sheet M is not particularly limited, and examples thereof include copper alloys such as brass and bronze, and stainless steel. The sheet thickness of the metal sheet M is not particularly limited and is set to 0.06 mm to 0.15 mm, for example.

Figure 14:
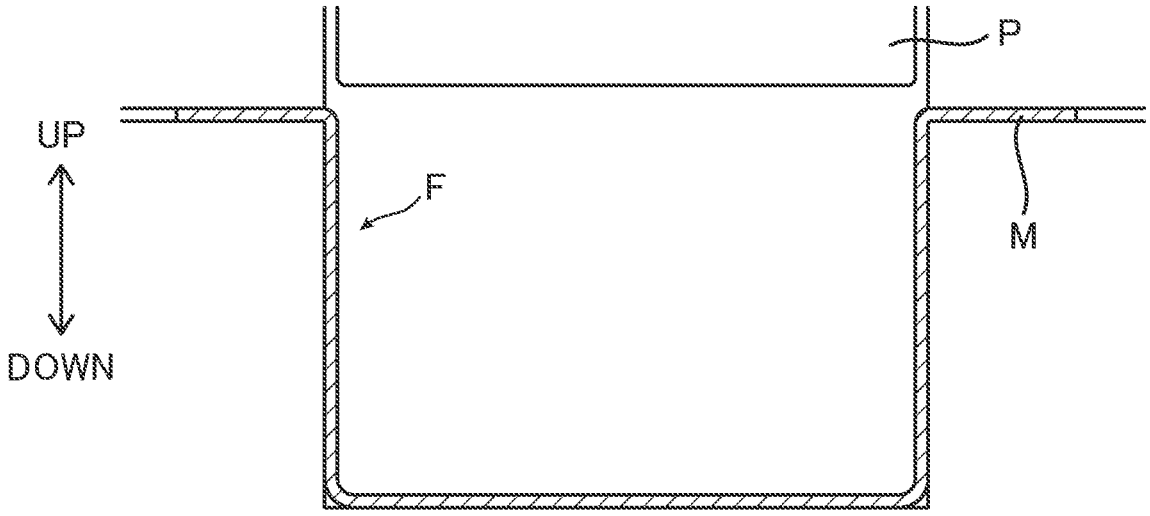
FIG. 14 is a view illustrating a deep drawing process.
Figure 15:
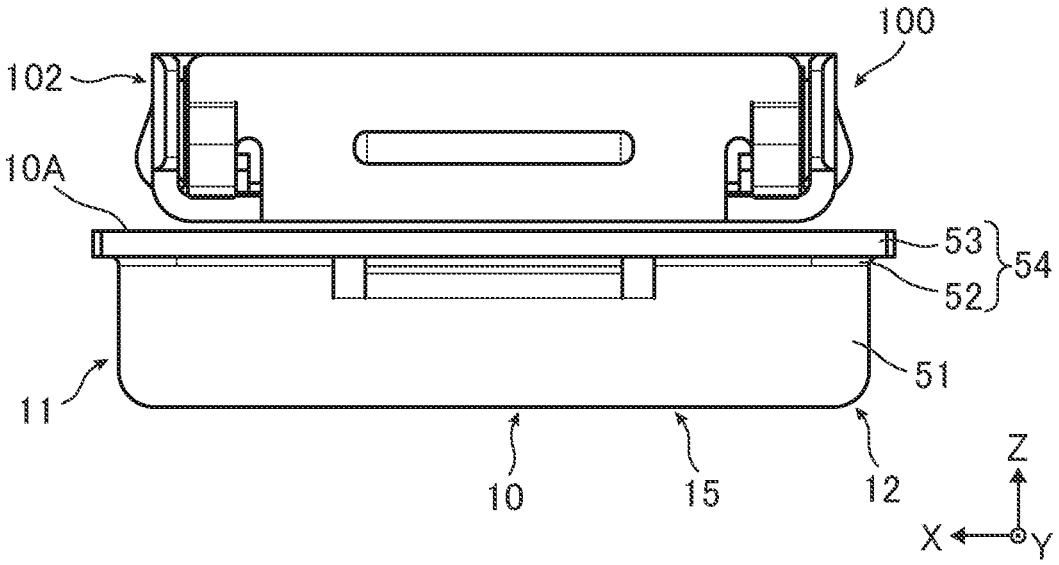
FIG. 15 is a view showing the connector and the counter connector in a process of fitting and is a front view showing each of the connector and the counter connector.

The frame 11 of the connector 10 of the invention can be produced by, for example, having the metal sheet M subjected to deep drawing process (more precisely, square-tubular deep drawing process) as shown in FIG. 14. In particular, with an outer edge portion of the metal sheet M being sandwiched and held by a die or other tools, a pressing tool P such as a punch is pressed against a portion of the metal sheet M, which portion is situated on an inner side from the outer edge portion. Consequently, as shown in FIG. 14, a metal molded article of square tubular shape having a drawn bottom portion (hereinafter, frame base material F) is obtained. The drawn bottom portion corresponds to a portion situated at an innermost portion (bottom portion) in the portion formed by pressing the metal sheet M in the deep drawing process.

In the frame base material F, an opening is formed on a surface side, against which surface the pressing tool P was pressed (hereinafter, upper surface side), and the opening constitutes the opening 10A when the frame 11 is completed. In addition, the square tubular portion of the frame base material F constitutes the lateral wall 12 when the frame 11 is completed. In addition, of the metal sheet M, the outer edge portion that was held in the deep drawing process remains as a jaw-like edge portion on the upper surface side of the frame base material F and constitutes the flange portion 53 when the frame 11 is completed.

Following the deep drawing process, the bottom portion of the frame base material F is punched out in a predetermined shape. Consequently, of the frame base material F, a portion corresponding to the bottom wall 17 (more precisely, the edge portion 18 and the corner portion 19) of the frame 11 and portion corresponding to the blocking portion 40 remain in the drawn bottom portion. At this time, the portion corresponding to the bottom wall 17 (more precisely, the corner portion 19) is continuous with the portions corresponding to the blocking portions 40.

Subsequently, the drawn bottom portion is bent at a boundary between the portion corresponding to the bottom wall 17 and the portion corresponding to the blocking portion 40. More specifically, of the drawn bottom portion, the portion corresponding to the blocking portion 40 is bent by substantially 90 degrees with respect to the portion corresponding to the bottom wall 17 to be thereby risen.

Through the foregoing procedure, the frame 11 is produced from the single metal sheet M. In the frame 11 produced according to the foregoing procedure, the lateral wall 12 is seamlessly continuous over an entire circumference of the frame 11. With this configuration, strength and blocking property (shielding property) of the frame 11 are ensured.

In addition, the rising portion 51 and the flange portion 53 are seamlessly joined to one another in each portion of the lateral wall 12. Between the rising portion 51 and the flange portion 53, provided is the bending portion 52, and the bending portion 52 and the flange portion 53 constitute the guide portion 54. In the production process of the frame 11 involving the deep drawing process to a single metal sheet M as described above, the guide portion 54 can be concomitantly formed.

Moreover, the lateral wall 12 and the bottom wall 17 of the frame 11 are seamlessly joined to one another, while the blocking portion 40 is seamlessly joined to the bottom wall 17. In particular, the blocking portion 40 is formed by bending the metal sheet M at the boundary portion of the metal sheet M between the bottom wall 17 and the blocking portion 40. In this manner, the number of components constituting the connector can be reduced, as compared to a conventional connector requiring disposing the frame 11 and the blocking portion 40 separately (for example, the connector 1 described in the specification of CN Utility Model No. 211126218).

More specifically, when the frame 3 of the connector 1 described in the specification of CN Utility Model No. 211126218 is produced through the deep drawing process, a surface against which the pressing tool P is pressed in the process (in other words, a surface on the side where the flange portion is formed) is fixed to the board (not shown). On the other hand, the drawn bottom portion formed by pressing the pressing tool P thereto is punched out, and the punched hole constitutes the opening 2 for allowing the counter connector to be fitted in an inside of the frame 3. In a case where the blocking portion 5 is disposed in the inside of the frame 3 that is produced according to this procedure, a component to form the blocking portion 5 is prepared in addition to the frame 3, and this component is to be assembled to a lower end portion (end portion on the board side) of the frame 3.

On the contrary, while the frame 11 of the connector 10 according to the invention is produced through the deep drawing process, a surface pressed with the pressing tool P in the process becomes a top surface (+Z side surface). That is, the drawn bottom portion formed by pressing the pressing tool P thereto corresponds to the lower end portion of the frame 11. This configuration allows the blocking portion 40 to be formed using part of the drawn bottom portion. Accordingly, the blocking portion 40 need not be formed as an independent component, whereby the number of constituting components is reduced. In addition, the reduced number of constituting components leads to the cost reduction of the connector production.

Moreover, when the frame 3 of the connector 1 described in the specification of CN Utility Model No. 211126218 is produced through the deep drawing process, as described above, the drawn bottom portion is punched out or the like to form the opening 2 for fitting the counter connector. In this process, a relatively large hole in accordance with the size of the counter connector needs to be bored.

On the contrary, in the frame 11 of the connector 10 according to the invention, as described above, the opening formed by being pressed with the pressing tool P in the deep drawing process is directly utilized as the opening 10A for fitting the counter connector 100. That is, according to the invention, the drawn bottom portion need not be largely punched out to ensure the opening 10A, and the frame 11 having the opening 10A of necessary size can be easily produced through the deep drawing process.

As above, in the present invention, the frame 11 seamlessly integrated with the blocking portion 40 can be easily produced by having the single metal sheet M subjected to the deep drawing process and the bending process. With this configuration, it is possible to provide a connector whose production cost is inexpensive.

Other Embodiments

While the configuration of connector according to the invention has been described above with reference to a specific example, the foregoing embodiment is mere an example used to facilitate the understanding of the invention, and there may be other embodiments.

In the embodiment described above, the lateral wall 12 and the bottom wall 17 of the frame 11 and the blocking portion 40 are made of a single member and are integrated, and the blocking portion 40 protrudes from the bottom wall 17 to the +Z side. In other words, in the embodiment described above, the blocking portion 40 is continuous with the bottom wall 17, but the invention is not limited thereto. For instance, the blocking portion 40 may be continuous with the lateral wall 12, specifically, the blocking portion 40 may extend from one or both of the pair of long side portions 13 and 14 of the lateral wall 12 in the X direction.

In addition, in the embodiment described above, an example where the frame 11 having a seamless structure is produced through the deep drawing process, the invention is not limited thereto; other processes may be adopted as long as the frame 11 having a seamless structure can be produced. For instance, processes such as the machining and the drawing may be adopted.

In the embodiment described above, the bending portion 52 and the flange portion 53 are provided at the upper end portion (end portion on the +Z side) of the lateral wall 12 of the frame 11. Meanwhile, the invention is not limited thereto, and it may be configured such that the bending portion 52 and the flange portion 53 are omitted, i.e., the upper end portion of the lateral wall 12 is not bent but extends straight to the +Z side.

In addition, in the embodiment described above, the lateral wall 12 of the frame 11 has a rectangular shape in a plan view. Meanwhile, the lateral wall 12 may take on another shape than a rectangular shape in a plan view, and examples of the shape include a circular shape, an elliptic shape, a rhomboid shape, a trapezoidal shape and a parallelogram shape as well as a polygonal shape other than a rectangular shape.

What is claimed is:

1. A connector comprising a frame and being capable of allowing a counter connector to be fitted in an inside of the frame, the connector comprising:

a lateral wall provided in the frame and surrounding the counter connector which is in a state of being fitted with the connector;

a first terminal and a second terminal separately disposed at different positions in the inside of the frame;

a blocking portion disposed between the first terminal and the second terminal in the inside of the frame; and a housing holding the first terminal and the second terminal, wherein the lateral wall is seamlessly continuous over an entire circumference of the frame, wherein the lateral wall and the blocking portion are formed of a single member and are integrated, wherein the housing is attached to the blocking portion and disposed in the inside of the frame, wherein, in a state where the counter connector is fitted with the connector, the blocking portion is fitted with a counter blocking portion of the counter connector to form an electromagnetic shield, and wherein the blocking portion includes a fitting portion for fitting with the counter blocking portion, and an attachment portion to which the housing is attached.

2. The connector according to claim 1, wherein the frame has an opening at one end of the frame in a fitting direction in which the connector and the counter connector are fitted with each other, wherein the counter connector enters the inside of the frame through the opening to be fitted with the connector, and wherein the blocking portion protrudes along the fitting direction from an end on an opposite side to the opening of the frame in the fitting direction.

3. The connector according to claim 2, wherein the frame includes a bottom wall extending toward the inside of the frame from an end portion of the lateral wall on an opposite side to the opening in the fitting direction, and wherein the lateral wall, the bottom wall and the blocking portion are formed of a single member and are seamlessly joined to one another.

4. The connector according to claim 3, wherein the lateral wall, the bottom wall and the blocking portion are formed of a single metal sheet, and wherein the blocking portion is formed by bending the metal sheet at a boundary portion between the bottom wall and the blocking portion in the metal sheet.

5. The connector according to claim 2, wherein, of the lateral wall, an end portion on a side on which the opening is situated in the fitting direction is provided with a flange portion extending toward an outside of the frame, and wherein the flange portion is seamlessly joined to a portion extending in the fitting direction in the lateral wall.

6. The connector according to claim 1, wherein the blocking portion is disposed between the first terminal and the second terminal in an intersecting direction intersecting a fitting direction, in the fitting direction the connector and the counter connector being fitted with each other, and wherein, in the intersecting direction, an end surface of the fitting portion and an end surface of the attachment portion are coplanar with each other.

7. The connector according to claim 1, wherein the fitting portion enters a recess portion provided to the counter blocking portion to be thereby fitted with the counter blocking portion, wherein the attachment portion includes an insertion recess portion into which part of the housing is inserted, and a press-fit portion protruding from an inner lateral surface of the insertion recess portion, and wherein the press-fit portion is press-fitted to the part of the housing, the part having been inserted into the insertion recess portion.

8. The connector according to claim 1, wherein the frame is conductive, wherein the first terminal and the second terminal are high-frequency signal transmitting terminals, wherein, in the inside of the frame, a third terminal which is a low-frequency signal transmitting terminal is additionally disposed between the first terminal and the second terminal, and wherein the blocking portion is disposed each between the first terminal and the third terminal and between the second terminal and the third terminal.

9. The connector according to claim 1, wherein the blocking portion is connected to a ground potential.

10. The connector according to claim 3, wherein, of the lateral wall, an end portion on a side on which the opening is situated in the fitting direction is provided with a flange portion extending toward an outside of the frame, and wherein the flange portion is seamlessly joined to a portion extending in the fitting direction in the lateral wall.

11. The connector according to claim 4, wherein, of the lateral wall, an end portion on a side on which the opening is situated in the fitting direction is provided with a flange portion extending toward an outside of the frame, and wherein the flange portion is seamlessly joined to a portion extending in the fitting direction in the lateral wall.

12. A connector comprising a frame and being capable of allowing a counter connector to be fitted in an inside of the frame, the connector comprising:

a lateral wall provided in the frame and surrounding the counter connector which is in a state of being fitted with the connector;

a first terminal and a second terminal separately disposed at different positions in the inside of the frame; and a blocking portion disposed between the first terminal and the second terminal in the inside of the frame, wherein the lateral wall is seamlessly continuous over an entire circumference of the frame, wherein the lateral wall and the blocking portion are formed of a single member and are integrated, wherein the frame has an opening at one end of the frame in a fitting direction in which the connector and the counter connector are fitted with each other, wherein the counter connector enters the inside of the frame through the opening to be fitted with the connector, wherein the blocking portion protrudes along the fitting direction from an end on an opposite side to the opening of the frame in the fitting direction, wherein, of the lateral wall, an end portion on a side on which the opening is situated in the fitting direction is provided with a flange portion extending toward an outside of the frame, and wherein the flange portion is seamlessly joined to a portion extending in the fitting direction in the lateral wall.

* * * * *